US005407393A

United States Patent [19]

Schmidt

[11] Patent Number: 5,407,393

[45] Date of Patent: Apr. 18, 1995

[54] LOW FLOW, SELF-HEATING WATER SLIDE

[76] Inventor: Gregory A. Schmidt, 26527 Fairwood Dr., Chesterfield, Mich. 48051

[21] Appl. No.: 160,773

[22] Filed: Dec. 3, 1993

[51] Int. Cl.[6] ..... A63G 21/18

[52] U.S. Cl. ..... 472/117; 472/128; 104/69

[58] Field of Search ..... 472/116, 117, 128; 104/69, 70; D21/241, 242, 243, 244, 245; 193/11, 2 R

[56] References Cited

U.S. PATENT DOCUMENTS

| | | | |
|---|---|---|---|
| 3,796,429 | 3/1974 | Johnston | 472/116 |
| 4,149,710 | 4/1979 | Roughard | 472/117 X |
| 4,484,739 | 11/1984 | Kreinbihl et al. | 472/117 X |
| 4,805,898 | 2/1989 | Jacober et al. | 472/117 |
| 5,137,497 | 8/1992 | Dubeta | 472/117 X |
| 5,213,547 | 5/1993 | Lochtefeld | 472/117 |

*Primary Examiner*—Carl D. Friedman
*Assistant Examiner*—Kien T. Nguyen
*Attorney, Agent, or Firm*—Daryl C. Josephson; Kevin A. Sembrat

[57] ABSTRACT

A water slide includes a water distributor depressed within the slide surface near the upper end of the slide and one or more sets of water outlets to spread a small volume of water evenly accross the slide surface between two integral side walls. Water is drawn from a pool into which the lower end of the water slide projects and is pumped onto the slide surface through the water outlets using a conventional, inexpensive water pump, hoses and fittings. The dark color of the slide surface absorbs heat from the sun which is then transferred to the small volume of water flowing down the pitched slide surface. A support means and an access means are mounted to the water slide. The lower end of the slide has a steeper pitch, allowing the slide to be supported in various positions. The speed of descent can therefore be adjusted to accommodate various user needs.

5 Claims, 3 Drawing Sheets

LOW FLOW, SELF-HEATING WATER SLIDE

BACKGROUND OF THE INVENTION

This invention relates to recreational water slides.

Water slides for amusement purposes are well known and typically comprise a fixed support structure, a lightly-colored shade and a large pump to circulate a water over the entire slide surface such that a layer of water reduces friction between the slide surface and persons sliding down it.

A feature of present water slides which increases manufacture and operation costs and limits the useful life of the water slide is that adequate coverage of the slide surface is achieved by circulating large volumes of water. This necessitates the use of a larger, more expensive and energy consuming water circulating system. It also renders heating the water on the slide surface impractical, limiting usage in cooler climates. Further, increased curvature of the slide due to repeated use may cause water to collect along the center axis of the slide and thus degrade coverage of the slide surface.

A further feature of present water slides which increases cost and decreases their usefulness and safety is that the fixed support structure and preformed slide provide no means for adjusting the pitch of the slide surface. Thus the speed of descent and trajectory path upon exiting the water slide cannot be slowed for small children or to accommodate a more shallow pool. Each requirement therefore requires a specially manufactured slide.

Thus there is a need to decrease the volume of water required to adequately cover the slide surface, to provide a practical means for heating the water and to provide a means by which the user can control the pitch of the slide.

SUMMARY OF THE INVENTION

Accordingly, an object of the invention is to provide a means for adequately covering the slide surface using a small volume of water, thus requiring a simpler, less expensive means for drawing water from a pool and depositing it onto the slide surface.

A second object of the invention is to provide a darkly colored slide surface causing the slide to absorb heat from the sun. The smaller volume of water now required along with the resulting slow and even distribution of water on the slide surface allows the heated slide surface to effectively warm the water. The advantage is that the water slide can be used more comfortably in cooler climates for longer periods of time without requiring the addition of a specially designed heating element.

An adjustable support structure and steeper pitch at the lower end of the slide further allows the pitch of the slide to be adjusted. Therefore the speed of descent to be reduced or increased for use by children of various ages and sizes. In addition, a reduceable slide pitch allows a single slide to be adjusted for shallower pools in which it is necessary to project the user in a safer, more horizontal direction. Finally, fewer models need be produced to accommodate various buyer needs, thus reducing manufacturing costs.

These and other features, objects and advantages of the invention can best be understood by reference to the following description thereof together with the drawings.

DETAILED DESCRIPTION OF THE PREFERRED EMBODIMENT

Figure 1:
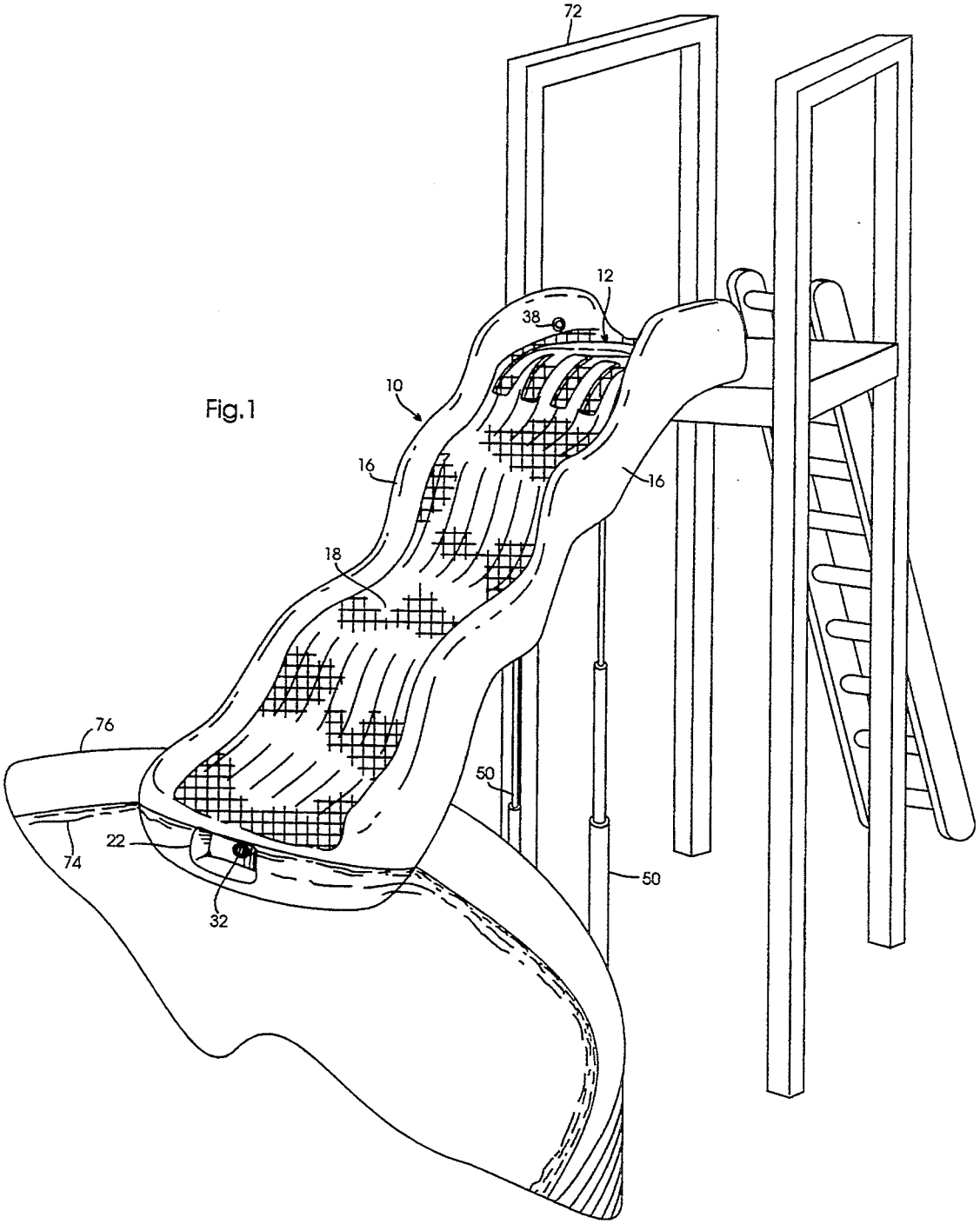
FIG. 1 is a perspective view of the water slide.

Referring to the drawings, FIG. 1 shows a moulded water slide 10 along with an access means 72 secured to the top end of the water slide 50, a support means 40 extending downward from the water slide 10 and a pool 74 into which the lower end of the water slide 10 extends.

Pool water entering a water inlet 32 is circulated through a plurality of water outlets 14 and accross the slide surface 18. An integral water distributor 12 then acts to direct the water evenly between side walls 16 integral to the slide surface 18. Thus the entire slide surface 18 can be coated with a small volume of water, despite natural curving of the slide surface due 18 to repeated use. The small volume of water so distributed on the slide surface 18 reduces friction between the slide surface 18 and persons sliding down the water slide 10 into a pool 74. The dark color of the slide surface 18 allows the slide surface 18 to absorb sufficient heat from the sun to effectively warm the smaller volume of water passing over the slide surface 18.

Figure 2:
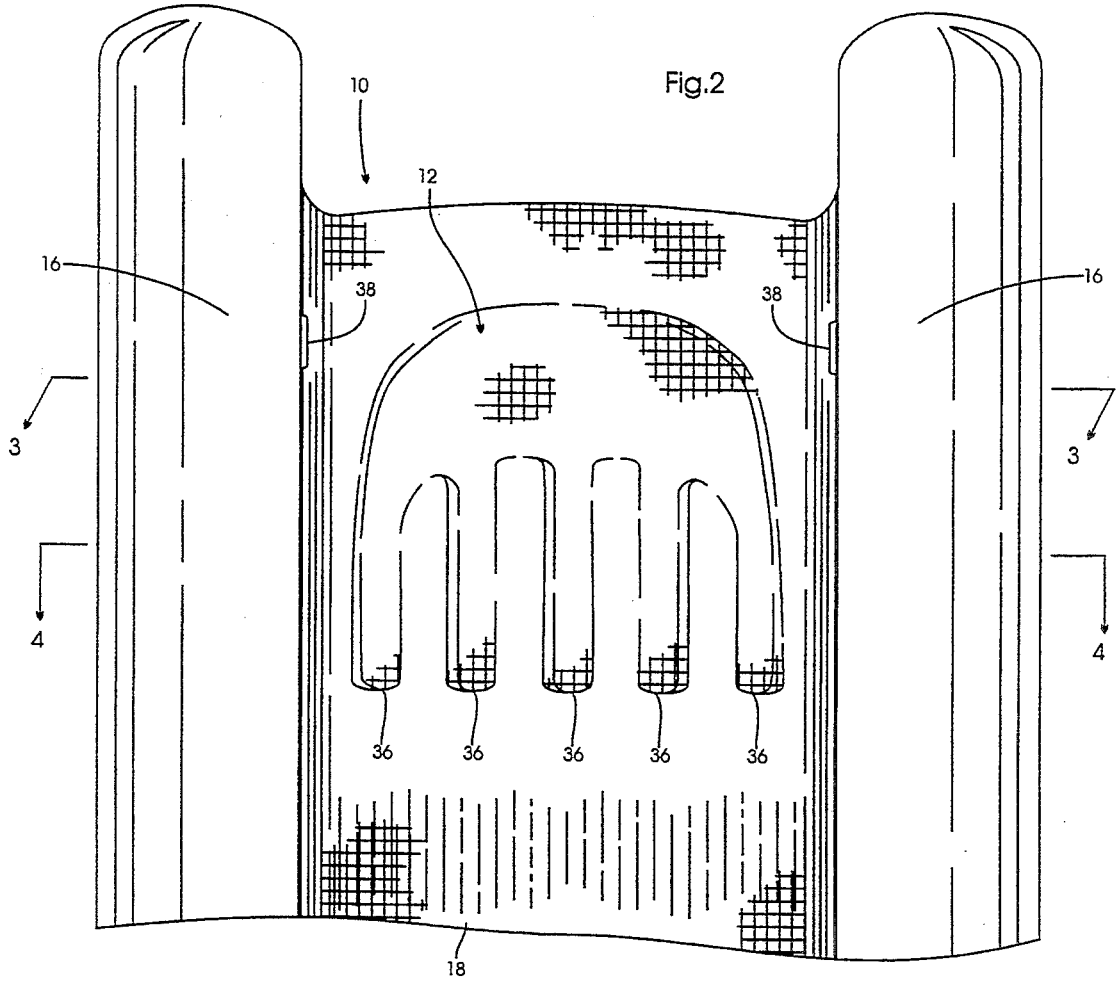
FIG. 2 is a top plan view of the water slide showing the water distributer.
Figure 3:
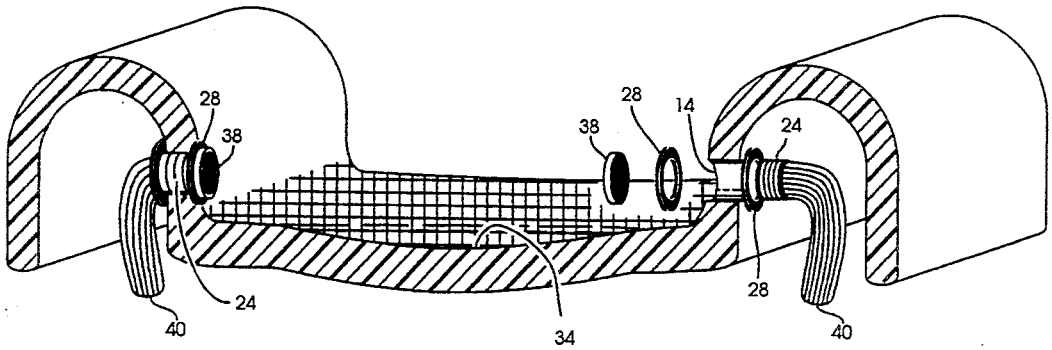
FIG. 3 is a perspective view of a cross section of the water slide taken along the line 3—3 of FIG. 2.
Figure 4:
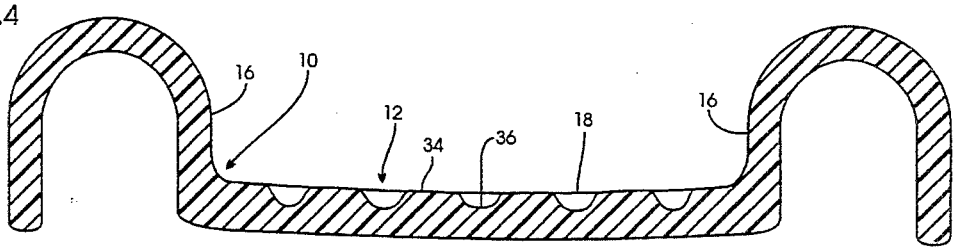
FIG. 4 is a cross-sectional view taken along the line 4—4 of FIG. 3

FIG. 2, FIG. 3 and FIG. 4 show how the integral water distributor 12 acts to channel water more evenly accross the slide surface 18. Water pumped through the water outlets 14 is gathered in a trough 34 and is then distributed by a plurality of shallow trough legs 36 integral to the water distributor 12. As FIG. 3 indicates, each outlet hose 40 includes a threaded hose connection 24 that extends through the slide surface 18. The threaded hose connection 24 is secured to the slide surface 18 in a conventional manner, using two hose seals 28 and a threaded closure ring 38.

Figure 5:
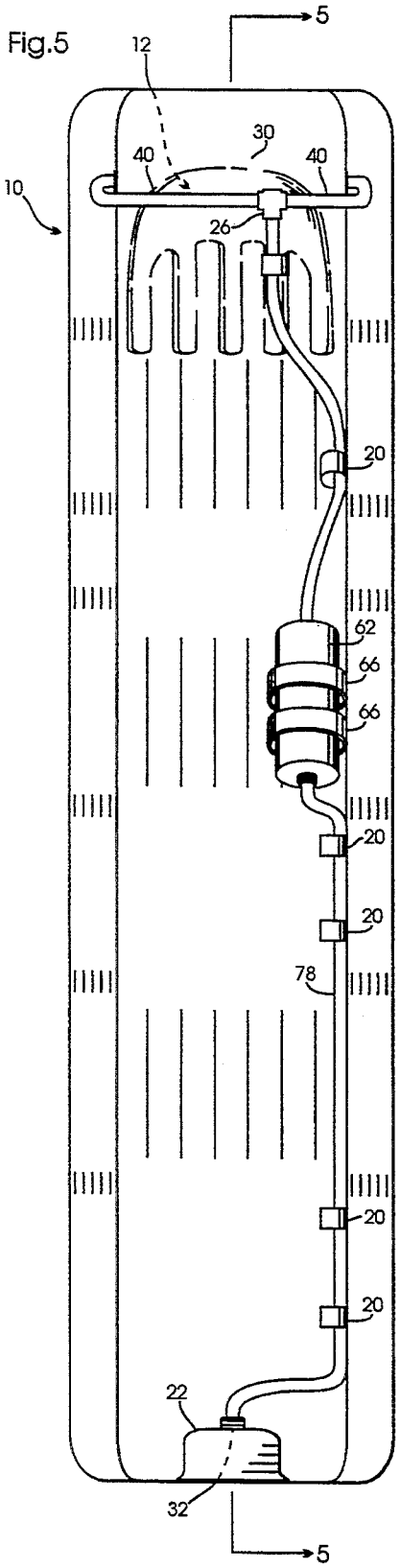
FIG. 5 is a bottom plan view of the water slide with the support means omitted for clarity.
Figure 6:
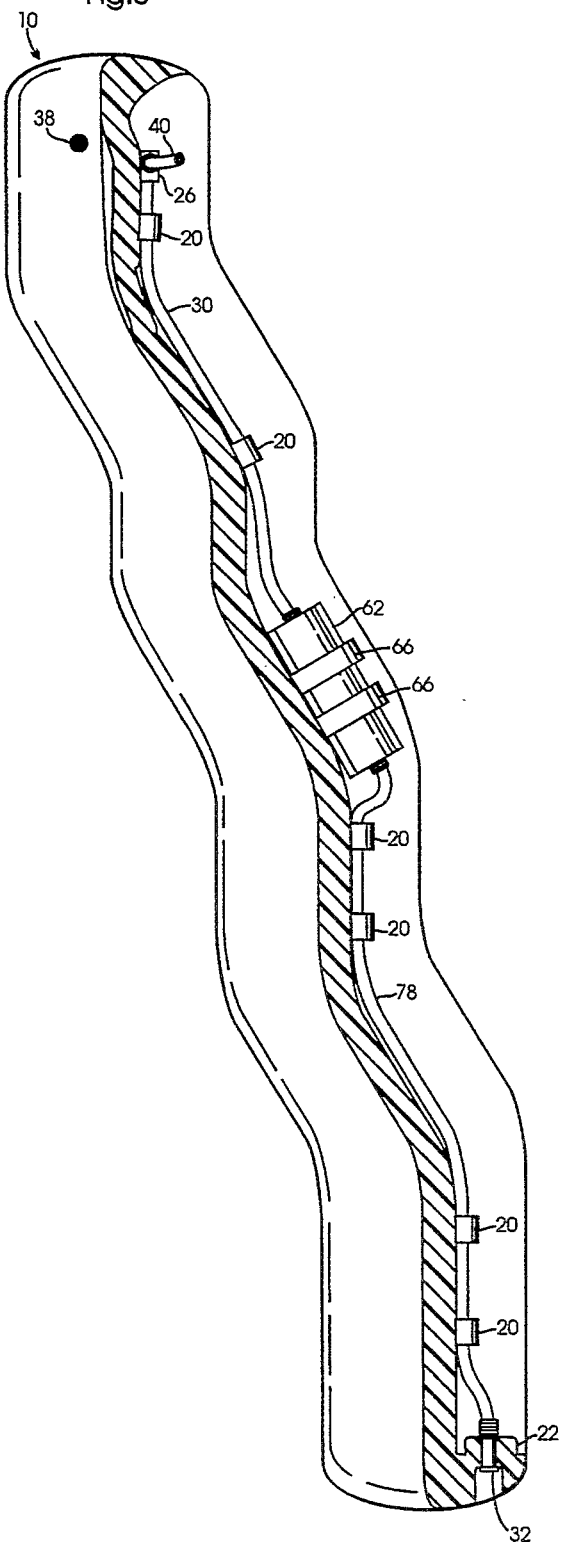
FIG. 6 is a cross-sectional view taken along line 5—5 of FIG. 5.

FIG. 5 and the cross sectional view taken along line 5—5 of FIG. 5 (FIG. 6) show how water entering the water inlet 32 is drawn through a recessed water intake 22. The water is further drawn through a pump intake hose 78 to the operating water pump 62. The water pump 62 then forces the water through a supply hose 30, a conventional splitter means 26 and outlet hoses 40 to the water outlets 14.

While the above description contains many specificities, these should not be construed as limitations on the scope of the invention, but rather as an example of the preferred embodiment thereof. Many other variations are possible.

For example, a water distribution system with only one water outlet 14 in each side wall 16 requires a minimum number of conventional flexible hoses and fittings. Water propelled by the water pump 62 passes through a supply hose 30 and a conventional T-shaped connector 26 into only two outlet hoses 40, each hose being affixed to a respective side wall 16. However, a single water outlet through the center axis of the slide surface can also be used with a conventional water spreading and directing fitting. Similarly, additional water outlets 14 can be added using conventional means and conventional hoses and fittings without requiring a larger, more expensive water pump 62.

Accordingly, the scope of the invention should be determined, not by the embodiment described, but by the appended claims and their legal equivalents.

I claim:

1. A low flow, self-heating water slide, comprising:

a slide, the slide having a slide surface and a support surface, the slide surface having an upper end, a lower end and two sides, the slide surface also having two integral side walls curving upwardly from the sides and an integral water distributor depressed within the slide surface near the upper end of the slide surface, the water distributor having a shallow trough, the trough extending toward the lower end of the slide surface and toward the side walls, forming a plurality of trough legs, for channeling water more evenly across the slide surface, a connecting means at the upper end of the slide surface for affixing the slide surface to an access means, a water circulating means comprising a water intake at the lower end of the slide surface, an intake hose, a water pump, a supply hose, a plurality of outlet hoses and a connecting means, the intake hose connecting the water intake to the water pump, the supply hose connecting the pump to the connecting means, the connecting means connecting the supply hose to a plurality of outlet hoses, each outlet hose projecting through and affixed to the slide surface, a support means extending downward from the support surface of the slide.

2. A low flow, self-heating water slide as in claim 1, wherein the slide surface is darkly colored, thereby absorbing heat from the sun.

3. A low flow, self-heating water slide as in claim 2, wherein the slide surface has a steeper pitch at its lower end such that the support means can be adjusted to accommodate persons of varying ages. and physical characteristics and to accommodate pools of various depths.

4. A low flow, self-heating water slide as in claim 2, further comprising an access means, the access means being affixed to the upper end of the slide surface.

5. A low flow, self-heating water slide as in claim 4, wherein the slide surface has a steeper pitch at its lower end such that the support means can be adjusted to accommodate persons of varying ages and physical characteristics and to accommodate pools of various depths.

* * * * *